US009885995B2

(12) United States Patent
Ohashi et al.

(10) Patent No.: US 9,885,995 B2
(45) Date of Patent: Feb. 6, 2018

(54) ALUMINUM ALLOY AND PROCESS FOR PRODUCING ALUMINUM ALLOY EXTRUSIONS

(75) Inventors: Yoshimasa Ohashi, Oyama (JP); Koji Hisayuki, Oyama (JP); Yoshikazu Kato, Oyama (JP); Kazunori Sakayori, Oyama (JP); Ryouta Kimura, Oyama (JP); Shigeru Aoya, Oyama (JP)

(73) Assignee: SHOWA DENKO K.K., Tokyo (JP)

( * ) Notice: Subject to any disclaimer, the term of this patent is extended or adjusted under 35 U.S.C. 154(b) by 530 days.

(21) Appl. No.: 14/128,641

(22) PCT Filed: Jun. 25, 2012

(86) PCT No.: PCT/JP2012/066158

§ 371 (c)(1),
(2), (4) Date: Feb. 27, 2014

(87) PCT Pub. No.: WO2013/005599

PCT Pub. Date: Jan. 10, 2013

(65) Prior Publication Data

US 2014/0227130 A1 Aug. 14, 2014

(30) Foreign Application Priority Data

Jul. 1, 2011 (JP) ..... 2011-147331

(51) Int. Cl.
*C22C 21/00* (2006.01)
*C22F 1/04* (2006.01)
(Continued)

(52) U.S. Cl.
CPC ..... *G03G 15/75* (2013.01); *B21C 1/00* (2013.01); *B21C 23/00* (2013.01); *B21C 23/002* (2013.01);
(Continued)

(58) Field of Classification Search
CPC ..... C22C 21/00; C22F 1/04; G03G 5/105; G03G 15/75; B21C 1/00; B21C 23/00; B21C 23/002; B21C 23/085
See application file for complete search history.

(56) References Cited

U.S. PATENT DOCUMENTS 5,237,746 A * 8/1993 Aoki ..... B21C 23/085 29/527.4
5,573,445 A 11/1996 Rasmussen et al.
2001/0025676 A1 10/2001 Taguchi et al.

FOREIGN PATENT DOCUMENTS

JP 62-080246 A 4/1987
JP 01-176047 A 7/1989
(Continued)

OTHER PUBLICATIONS

"International Alloy Designations and Chemical Composition Limits for Wrought Aluminum and Wrought Aluminum alloys", The Aluminum Association, Revised, Jan. 2015.*
(Continued)

*Primary Examiner* — Lois Zheng
(74) *Attorney, Agent, or Firm* — Keating and Bennett, LLP

(57) ABSTRACT

An aluminum alloy has a composition consisting of Si: 0.03 to 0.6 mass %, Fe: 0.1 to 0.7 mass %, Cu: 0.05 to 0.20 mass %, Mn: 1.0 to 1.5 mass %, Mg: 0.01 to 0.1 mass %, Zn: 0 to 0.1 mass %, Ti: 0 to 0.1 mass %, and the balance being Al and inevitable impurities.

8 Claims, 1 Drawing Sheet

(51) Int. Cl.

| | |
|---|---|
| ***B21C 23/00*** | (2006.01) |
| ***G03G 15/00*** | (2006.01) |
| ***B21C 23/08*** | (2006.01) |
| ***G03G 5/10*** | (2006.01) |
| ***B21C 1/00*** | (2006.01) |

(52) U.S. Cl.

CPC ..... *B21C 23/085* (2013.01); *C22C 21/00* (2013.01); *G03G 5/102* (2013.01); *C22F 1/04* (2013.01)

(56) References Cited

FOREIGN PATENT DOCUMENTS

| | | | |
|---|---|---|---|
| JP | 01-285953 | A | 11/1989 |
| JP | 03-134128 | A | 6/1991 |
| JP | 05-185205 | A | 7/1993 |
| JP | 05-224449 | A | 9/1993 |
| JP | 06-212331 | A | 8/1994 |
| JP | 07-284840 | A | 10/1995 |
| JP | 08-076386 | A | 3/1996 |
| JP | 08-269604 | A | 10/1996 |
| JP | 09-179323 | A | 7/1997 |
| JP | 11-124648 | A | 5/1999 |
| JP | 11-172388 | A | 6/1999 |
| JP | 2000-075531 | A | 3/2000 |
| JP | 2002-294379 | A | 10/2002 |
| JP | 2004-358555 | A | 12/2004 |
| JP | 2008-169417 | A | 7/2008 |
| JP | 2009-145451 | A | 7/2009 |
| JP | 2009-181112 | A | 8/2009 |
| JP | 2010-082657 | A | 4/2010 |
| JP | 2010-139702 | A | 6/2010 |
| JP | 2010-156769 | A | 7/2010 |
| JP | 2011-089196 | A | 5/2011 |

OTHER PUBLICATIONS

Official Communication issued in International Patent Application No. PCT/JP2012/066158, dated Aug. 21, 2012.

* cited by examiner

ALUMINUM ALLOY AND PROCESS FOR PRODUCING ALUMINUM ALLOY EXTRUSIONS

TECHNICAL FIELD

The present invention relates to an aluminum alloy, a production method of an aluminum alloy extruded member, a production method of a photoconductor drum substrate, an aluminum alloy extruded member, and a photoconductor drum substrate.

TECHNICAL BACKGROUND

In a photoconductor drum substrate for use in electrophotographic devices such as, copiers, laser beam printers, facsimile devices, etc., a photosensitive layer such as an OPC layer is thinly applied on the outer surface so that the thickness becomes uniform.

An outer surface of an aluminum alloy tube used for the substrate is required to have a high surface smoothness so that a photosensitive layer having a uniform thickness can be applied thereon.

Conventionally, a high surface smoothness was obtained by machining an outer surface of an aluminum alloy tube. In the method, however, since it is not easy to adjustment and/or manage the machining tools and the machining operation demand skill and experiences, there is a problem that this method is not suitable for mass production. A tube obtained by machining the outer surface as mentioned above is called a "machined tube."

Under the circumstance, in recent years, a non-machined tube, such as a drawn tube obtained by drawing an aluminum alloy extruded tube, an ironed tube obtained by ironing an aluminum alloy extruded tube, etc., has come into use.

In such a non-machined tube, the surface quality of the outer surface is largely affected not only by the processing accuracy of the drawing process or the ironing process as a final process but also by the surface quality of the outer surface of the extruded tube. Therefore, in order to assuredly make the outer surface of the non-machined tube into a high smooth surface, it is required to improve the surface quality of the outer surface of the extruded tube.

As a technology to improve surface quality of an outer surface of an extruded tube, it is known, as described in Japanese Unexamined Patent Application Publication H7-284840 (JP-7-284840, A) (Patent Document 1), to extrude an aluminum billet using an extrusion die having a bearing portion made of WC-Co series superhard alloy containing cobalt of less than 16%, or as described in Japanese Unexamined Patent Application Publication No. 2004-358555 (JP-2004-358555, A) (Patent Document 2), to extrude an aluminum billet in which the maximum thickness of the solidified shell layer of the outer peripheral surface is 13 mm or less.

PRIOR ART DOCUMENT

Patent Document

Patent Document 1: Japanese Unexamined Patent Application Publication No. H7-284840

Patent Document 2: Japanese Unexamined Patent Application Publication No. 2004-358555

SUMMARY OF THE INVENTION

Problems to be Solved by the Invention

However, in the aforementioned conventional technologies, it was difficult to make the outer surface of the extruded tube into a sufficiently high smooth surface.

The present invention was made in view of the aforementioned technical background, and aims to provide an aluminum alloy capable of forming a high smooth surface, a production method of an aluminum alloy extruded member using the aluminum alloy, a production method of a photoconductor drum substrate using the extruded member, an aluminum alloy extruded member, and a photoconductor drum substrate.

The other objects and advantages of the present invention will be apparent from the following preferred embodiments.

Means to Solve the Problems

The present invention provides the following means.

[1] An aluminum alloy having a composition consisting of Si: 0.03 to 0.6 mass %, Fe: 0.1 to 0.7 mass %, Cu: 0.05 to 0.20 mass %, Mn: 1.0 to 1.5 mass %, Mg: 0.01 to 0.1 mass %, Zn: 0 to 0.1 mass %, Ti: 0 to 0.1 mass %, and the balance being Al and inevitable impurities.

[2] A production method of an aluminum alloy extruded member, wherein an aluminum alloy billet having the composition as recited in Item 1 is extruded.

[3] The production method of an aluminum alloy extruded member as recited in Item 2, wherein the extruded member is an aluminum alloy extruded tube for a photoconductor drum substrate.

[4] A production method of a photoconductor drum substrate, wherein the aluminum alloy extruded tube for a photoconductor drum substrate obtained by the production method of an aluminum alloy extruded member as recited in Item 3 is drawn.

[5] A production method of a photoconductor drum substrate, wherein the aluminum alloy extruded tube for a photoconductor drum substrate obtained by the production method of an aluminum alloy extruded member as recited in Item 3 is ironed.

[6] An aluminum alloy extruded member having a composition consisting of Si: 0.03 to 0.6 mass %, Fe: 0.1 to 0.7 mass %, Cu: 0.05 to 0.20 mass %, Mn: 1.0 to 1.5 mass %, Mg: 0.01 to 0.1 mass %, Zn: 0 to 0.1 mass %, Ti: 0 to 0.1 mass %, and the balance being Al and inevitable impurities.

[7] The aluminum alloy extruded member as recited in Item 6, wherein the extruded member is an aluminum alloy extruded tube for a photoconductor drum substrate.

[8] A photoconductor drum substrate made of an aluminum alloy having a composition consisting of Si: 0.03 to 0.6 mass %, Fe: 0.1 to 0.7 mass %, Cu: 0.05 to 0.20 mass %, Mn: 1.0 to 1.5 mass %, Mg: 0.01 to 0.1 mass %, Zn: 0 to 0.1 mass %, Ti: 0 to 0.1 mass %, and the balance being Al and inevitable impurities.

Effect of the Invention

The present invention exerts the following effects.

In the invention of the aforementioned Item [1], since the content of each element constituting the composition of the aluminum alloy is set within the predetermined range, when the aluminum alloy billet is extruded for example, the surface of the extruded member to be obtained can be formed into a high smooth surface. Specifically, in the aluminum alloy, since the Mg content is set within a range of 0.01 to 0.1 mass %, the surface of the extruded member can be assuredly formed into a high smooth surface. That is, since the Mg content is 0.01 mass % or more, a die mark originating portion formed on a bearing portion of an extrusion die is coated by a thin Mg film at the time of an extrusion process. As a result, a die mark can be prevented from being formed on a surface of an extruded member. Also, since the Mg content is 0.1 mass % or less, rough crystallized products can be prevented from being formed in the aluminum alloy during the extrusion process. Therefore, by setting the Mg content within a range of 0.01 to 0.1 mass %, the surface of the extruded member can be assuredly formed into a high smooth surface.

In the invention of the aforementioned Item [2], by extruding the aluminum alloy billet having the composition as recited in Item [1], the surface of the extruded member can be assuredly formed into a high smooth surface.

In the invention of the aforementioned Item [3], the outer surface of the aluminum alloy extruded tube for a photoconductor drum substrate as an extruded member can be assuredly formed into a high smooth surface.

In the inventions of the aforementioned Items [4] and [5], a photoconductor drum substrate having a high smooth outer surface can be obtained.

In the invention of the aforementioned Item [6], an aluminum alloy extruded member having a high smooth outer surface can be provided.

In the invention of the aforementioned Item [7], an aluminum alloy extruded tube for a photoconductor drum substrate having a high smooth outer surface can be provided as an extruded member.

In the invention of the aforementioned Item [8], a photoconductor drum substrate having a high smooth outer surface can be provided

EMBODIMENTS FOR CARRYING OUT THE INVENTION

Next, an embodiment of the present invention will be explained with reference to the attached drawings.

An aluminum alloy according to an embodiment of the present invention has a composition consisting of Si: 0.03 to 0.6 mass %, Fe: 0.1 to 0.7 mass %, Cu: 0.05 to 0.20 mass %, Mn: 1.0 to 1.5 mass %, Mg: 0.01 to 0.1 mass %, Zn: 0 to 0.1 mass %, Ti: 0 to 0.1 mass %, and the balance being Al and inevitable impurities. The aluminum alloy basically has a composition close to aluminum alloy A3003 as defined by JIS (Japanese Industrial Standards) and includes 0.01 to 0.1 mass % of Mg as an essential element.

In this embodiment, this aluminum alloy is especially suitably used as an extruding material. Specifically, by extruding this aluminum alloy billet, an aluminum alloy extruded member is especially suitably produced. This extruded member is an aluminum alloy extruded tube (extruded blank tube) having a circular cross-section for use as a photoconductor drum substrate. By drawing or ironing the extruded tube, a drawn tube or an ironed tube as a non-machined tube is produced. Subsequently, by subjecting the drawn tube or the ironed tube to a predetermined process, a photoconductor drum substrate is produced.

Figure 1:
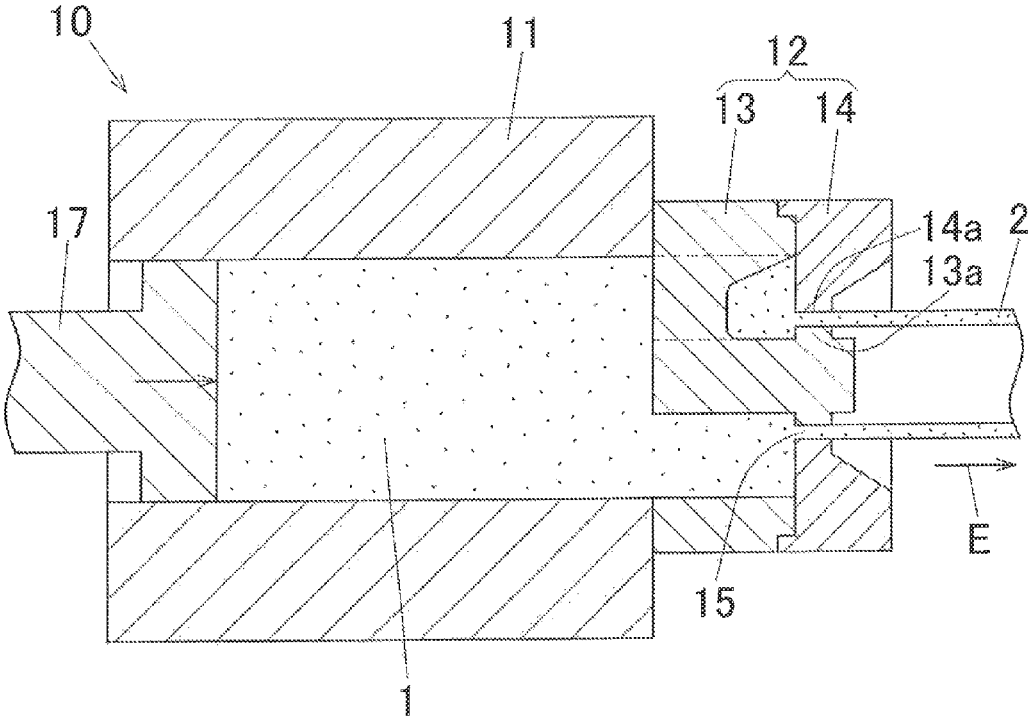
FIG. 1 is a schematic cross-sectional view showing an extrusion device used in a production method of an aluminum alloy extruded member according to an embodiment of the present invention in a state in the middle of an extrusion process.

As shown in FIG. 1, the extrusion device 10 used for extruding an aluminum alloy billet 1 is not specifically limited, and is a known device. That is, the extrusion device 10 is equipped with a container 11, an extrusion die 12, a stem 17, etc. The extrusion die 12 is, for example, a porthole die which is a combination of a male die 13 and a female 14, and includes a forming gap 15 having an annular cross-section formed between a male bearing portion 13*a* and a female bearing portion 14*a* disposed facing each other. The male bearing portion 13*a* and the female bearing portion 14*a* are configured to form an inner surface and an outer surface of the extruded tube 2, respectively.

A method of extruding the aluminum alloy billet 1 using the extrusion device 10 is not specifically limited, and the extrusion process is performed according to a known method. That is, for example, a heated aluminum alloy billet 1 loaded in the container 11 of the extrusion device 10 is pressurized in the extrusion direction E with the stem 17 to thereby make the material of the billet 1 pass through the forming gap 15 of the extrusion die 12. With this, an aluminum alloy extruded tube 2 circular in cross-section can be obtained. The outer diameter of the extruded tube 2 is, for example, 20 to 50 mm, and the thickness of the extruded tube 2 is, for example, 1.0 to 2.0 mm. The specifically preferred extrusion process conditions to be applied to the extrusion process are a billet temperature of 400 to 550° C. and an extrusion rate of 15 to 60 m/min.

Figure 2:
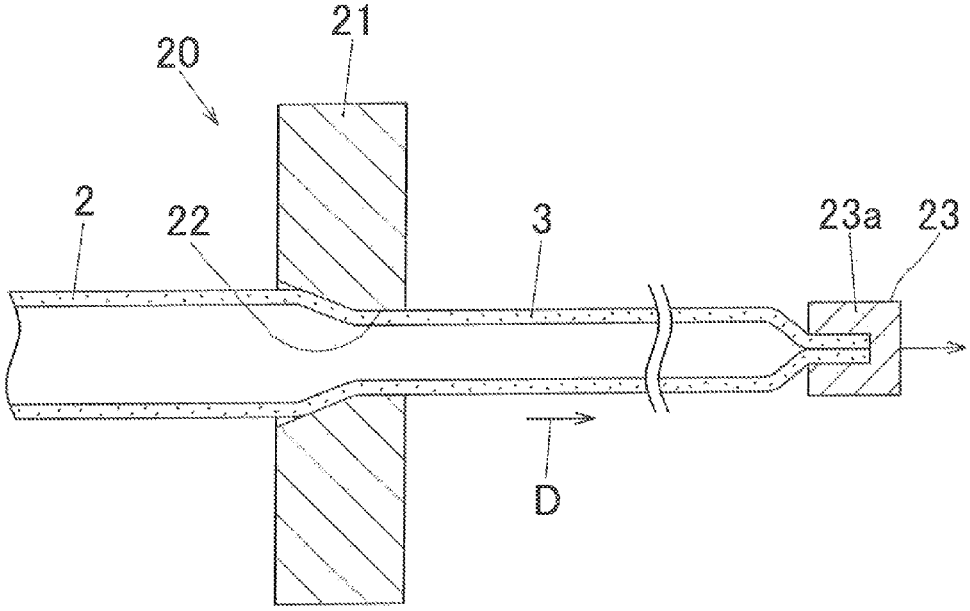
FIG. 2 is a schematic cross-sectional view showing a drawing device used for drawing an aluminum alloy extruded tube as an aluminum alloy extruded member in a state in the middle of a drawing process.

As shown in FIG. 2, a drawing device 20 used to draw the extruded tube 2 is not specifically limited, and is a known device. That is, this drawing device 20 includes a drawing die 21, a pulling portion 23, etc. The drawing die includes a die hole 22 to reduce the diameter of the extruded tube 2. The pulling portion 23 includes a chuck portion 23*a*.

The method of drawing the extruded tube 2 using the drawing device 20 is not specifically limited, and cold or warm drawing is performed according to a known method. That is, for example, the front end portion of the extruded tube 2 passed through the die hole 22 of the drawing die 21 of the drawing device 20 is chucked with the chuck portion 23*a* of the pulling portion 23, and then the extruded tube 2 is pulled in the drawing direction D with the pulling portion 23 to draw the extruded tube 2 from the die hole 22. With this, a drawn tube 3 as a non-machined tube can be obtained. The thickness of the drawn tube 3 is, for example, 0.5 to 1.5 mm. The especially preferred drawing process conditions to be applied to the drawing process are a drawing rate of 10 to 70 m/min and a diameter reduction rate of the outer diameter of the extruded tube 2 of 20 to 50%. In this drawing process, the drawing can be performed using a drawing plug (not illustrated) disposed in the hollow portion of the extruded tube 2 to process the inner surface of the extruded tube 2.

Next, the drawn tube 3 is cut into a piece having a length of a photoconductor drum substrate, the end portion of the cut piece is chamfered, the cut piece is cleaned, and dimensional and appearance inspections are performed. Thus, a desired photoconductor drum substrate is obtained.

When obtaining an ironed tube by ironing the extruded tube 2, using a known ironing device (not illustrated), an extruded tube is ironed under normal processing conditions. With this, an ironed tube is obtained.

Next, the ironed tube is cut into a piece having a length of a photoconductor drum substrate, the end portion of the cut piece is chamfered, the cut piece is cleaned, and dimensional and appearance inspections are performed. Thus, a desired photoconductor drum substrate is obtained.

In FIGS. 1 and 2, the billet 1, the extruded tube 2, and the drawn tube 3 are shown by dot-hatching to easily distinguish them from other members.

Next, functions of each element constituting the composition of the aluminum alloy of this embodiment will be explained.

<Si (Silicon)>

Si enhances castability and also contributes to improvement of strength. The effect is assuredly exerted when the Si content is 0.03 mass % or more. On the other hand, when the Si content exceeds 0.6 mass %, rough crystallized products are formed in the aluminum alloy, which deteriorates the surface roughness of the outer surface of the extruded tube. Therefore, it is preferable that the Si content is set within a range of 0.03 to 0.6 mass %. The especially desired range of the Si content is 0.03 to 0.3 mass %.

<Fe (Iron)>

Fe refines crystallized products and also contributes to improvement of strength. The effect is assuredly exerted when the Fe content is 0.1 mass % or more. On the other hand, when the Fe content exceeds 0.7 mass %, rough crystallized products are formed in the aluminum alloy, which deteriorates the surface roughness of the outer surface of the extruded tube. Therefore, it is preferable that the Fe content is set within a range of 0.1 to 0.7 mass %. The especially desired range of the Fe content is 0.1 to 0.5 mass %.

<Cu (Copper)>

Cu contributes to improvement of strength by the solid-solution strengthening effect. The effect is assuredly exerted when the Cu content is 0.05 mass % or more. On the other hand, when the Cu content exceeds 0.20 mass %, corrosion resistance decreases. Therefore, it is preferable that the Cu content is set within a range of 0.05 to 0.20 mass %. The especially desired range of the Cu content is 0.1 to 0.20 mass %.

<Mn (Manganese)>

Mn forms minute intermetallic compounds together with Fe, etc., contained in the aluminum alloy to raise the recrystallization temperature and also contributes to improvement of strength. The effect is assuredly exerted when the Mn content is 1.0 mass % or more. On the other hand, when the Mn content exceeds 1.5 mass %, there is a possibility to cause deterioration of corrosion resistance. Therefore, it is preferable that the Mn content is set within a range of 1.0 to 1.5 mass %. The especially desired range of the Mn content is 1.0 to 1.3 mass %.

<Mg (Magnesium)>

Mg forms a thin Mg film on the bearing portions 13*a* and 14*a* of the extrusion die 12 during an extrusion process, and the die mark originating portion formed on the bearing portions 13*a* and 14*a* is coated with the thin Mg film, which contributes to prevention of forming a die mark on the outer surface of the extruded tube. The effect is assuredly exerted when the Mg content is 0.01 mass % or more. On the other hand, when the Mg content exceeds 0.1 mass %, rough crystallized products are formed in the aluminum alloy, which deteriorates the surface roughness of the outer surface of the extruded tube 2. Therefore, it is preferable that the Mg content is set within a range of 0.01 to 0.1 mass %. The upper limit of the especially desired range of the Mg content is 0.05 mass %.

In this specification, the "die mark originating portion" refers to a portion that causes a die mark on the surface of the extruded tube 2 (outer surface and inner surface) and is formed on the bearing portions 13*a* and 14*a* of the extrusion die 12. Specifically, they are normally constituted by scratches formed on the bearing portions 13*a* and 14*a* or deposits adhered to the bearing portions.

<Zn (Zinc)>

Zn is an arbitrary element contained as needed, which slightly contributes to improvement of strength. When the Zn content exceeds 0.1 mass %, there is a possibility to decrease corrosion resistance. Therefore, it is preferable that the Zn content is set within a range of 0 to 0.1 mass %. The especially desired range of the Zn content is 0 to 0.05 mass %.

<Ti (Titanium)>

Ti is an arbitrary element contained as needed, and refines crystallized products of the billet 1 to thereby contribute to prevention of ingot cracking during a casting process. When the Ti content exceeds 0.1 mass %, there is a possibility that the extrusion workability deteriorates and large intermetallic compounds that adversely affect the workability are formed. Therefore, it is preferable that the Ti content is set within a range of 0 to 0.1 mass %. The especially desired range of the Ti content is 0.01 to 0.05 mass %.

Furthermore, the aluminum alloy of this embodiment contains Cr as an arbitrary element contained as needed, and it is preferable that the Cr content is set within a range of 0 to 0.05 mass %. The reason is as follows.

Cr has an effect of refining crystallized products, but when the Cr content exceeds 0.05 mass %, there is a possibility that large intermetallic compounds that adversely affect the workability are formed. Therefore, it is preferable that the Cr content is set within a range of 0 to 0.05 mass %. The upper limit of the especially preferred range of the Cr content is 0.03 mass %.

In the aluminum alloy of this embodiment, since the content of each element constituting the composition is set within the predetermined range, when the aluminum alloy billet 1 is extruded, the outer surface of the extruded tube 2 can be formed into a high smooth surface. Specifically, in this aluminum alloy, since the Mg content is set within the range of 0.01 to 0.1 mass %, the outer surface of the extruded tube 2 can be assuredly formed into a high smooth surface. That is, because the Mg content is 0.01 mass % or more, the die mark originating portion formed on the bearing portions 13*a* and 14*a* of the extrusion die 12 are coated by the thin Mg film during the extrusion process. As a result, a die mark can be prevented from being formed on the outer surface of the extruded tube 2. Further, because the Mg content is 0.1 mass % or less, rough crystallized products can be prevented from being formed in the aluminum alloy during the extrusion process. Therefore, by setting the Mg content within the range of 0.01 to 0.1 mass %, the outer surface of the extruded tube 2 can be assuredly formed into a high smooth surface.

By drawing or ironing the extruded tube 2, the outer surface of the drawn tube 3 or the ironed tube can be assuredly formed into a high smooth surface. Therefore, by producing a photoconductor drum substrate from the drawn tube 3 or the ironed tube, a photoconductor drum substrate having a high smooth outer surface can be obtained.

Although an embodiment of the present invention was explained above, the present invention is not limited to that. The present invention allows various design-changes falling within the claimed scope of the present invention unless it deviates from the spirits of the invention.

Further, in the present invention, an extruded member obtained by extruding an aluminum alloy billet is especially preferred to be used for a photoconductor drum substrate, but is not excluded from being used for other use applications. Further, the extruded member can be a tube (that is, a hollow member) as described in the aforementioned embodiment, or can be a solid member.

EXAMPLES

Next, specific examples of the present invention will be described. It should, however, be noted that the present invention is not limited to these examples.

TABLE 1

| | Composition (mass %) | | | | | | | | Surface roughness | Evaluation of surface |
|---|---|---|---|---|---|---|---|---|---|---|
| | Si | Fe | Cu | Mn | Mg | Zn | Ti | Al | Ry (μm) | property |
| Ex. 1 | 0.09 | 0.38 | 0.14 | 1.07 | 0.01 | 0.00 | 0.01 | Balance | 6.0 | ○ |
| Ex. 2 | 0.12 | 0.50 | 0.16 | 1.30 | 0.01 | 0.05 | 0.02 | Balance | 5.8 | ○ |
| Ex. 3 | 0.10 | 0.41 | 0.14 | 1.12 | 0.02 | 0.00 | 0.01 | Balance | 5.0 | ◎ |
| Ex. 4 | 0.03 | 0.10 | 0.17 | 1.06 | 0.02 | 0.01 | 0.01 | Balance | 4.9 | ◎ |
| Ex. 5 | 0.09 | 0.38 | 0.14 | 1.09 | 0.03 | 0.01 | 0.01 | Balance | 4.8 | ◎ |
| Ex. 6 | 0.30 | 0.70 | 0.15 | 1.20 | 0.03 | 0.00 | 0.02 | Balance | 4.7 | ◎ |
| Ex. 7 | 0.10 | 0.38 | 0.13 | 1.10 | 0.05 | 0.00 | 0.01 | Balance | 4.3 | ◎ |
| Ex. 8 | 0.60 | 0.40 | 0.05 | 1.20 | 0.05 | 0.02 | 0.02 | Balance | 4.6 | ◎ |
| Ex. 9 | 0.11 | 0.39 | 0.10 | 1.00 | 0.07 | 0.10 | 0.01 | Balance | 5.2 | ○ |
| Ex. 10 | 0.12 | 0.42 | 0.17 | 1.14 | 0.08 | 0.01 | 0.02 | Balance | 5.1 | ○ |
| Ex. 11 | 0.12 | 0.42 | 0.20 | 1.50 | 0.10 | 0.02 | 0.01 | Balance | 5.5 | ○ |
| Comp. Ex. 1 | 0.10 | 0.40 | 0.14 | 1.14 | 0.00 | 0.01 | 0.01 | Balance | 6.9 | X |
| Comp. Ex. 2 | 0.62 | 0.08 | 0.13 | 0.04 | 0.00 | 0.00 | 0.01 | Balance | 7.1 | X |
| Comp. Ex. 3 | 0.09 | 0.38 | 0.17 | 1.06 | 0.12 | 0.00 | 0.02 | Balance | 6.7 | X |
| Comp. Ex. 4 | 0.20 | 0.73 | 0.20 | 1.10 | 0.15 | 0.12 | 0.01 | Balance | 7.1 | X |
| Comp. Ex. 5 | 0.12 | 0.40 | 0.21 | 1.51 | 0.20 | 0.05 | 0.02 | Balance | 8.6 | X |

Aluminum alloy billets having the compositions as shown in Table 1 were extruded to thereby produce extruded tubes for photoconductor drum substrates. The outer diameter of the extruded tube was 32 mm, and the thickness of the extruded tube was 1.5 mm. The extrusion process conditions applied to the extrusion process were a billet temperature of 500° C. and an extrusion rate of 30 m/min.

Then, the surface roughness Ry of the outer surface of the extruded tube was measured according to JIS B0601-1994 to evaluate the surface properties of the outer surface. The results are shown in Table 1. In the column of "surface property" in Table 1, each symbol means as follows. The surface roughness Ry denotes a maximum height.

◎: Ry is 0 μm or more, but 5 μm or less

○: Ry exceeds 5 μm, but is 6 μm or less x: Ry exceeds 6 μm

As it can be understood from Table 1, in Examples 1 to 11, extruded tubes having high smooth outer surfaces were obtained.

Therefore, by drawing or ironing the extruded tubes obtained in Examples 1 to 11, drawn tubes or ironed tubes having high smooth outer surfaces can be obtained, which in turn can obtain photoconductor drum substrates having high smooth outer surfaces can be obtained.

The present invention claims priority to Japanese Patent Application No. 2011-147331 filed on Jul. 1, 2011, the entire disclosure of which is incorporated herein by reference in its entirety.

The terms and descriptions used herein are used only for explanatory purposes and the present invention is not limited to them. The present invention allows various design-changes falling within the claimed scope of the present invention unless it deviates from the spirits of the invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

INDUSTRIAL APPLICABILITY

The present invention is applicable to an aluminum alloy, a production method of an aluminum alloy extruded member, a production method of a photoconductor drum substrate, an aluminum alloy extruded member, and a photoconductor drum substrate.

DESCRIPTION OF THE REFERENCE NUMERALS

1: aluminum alloy billet

2: aluminum alloy extruded tube (aluminum alloy extruded member)

The invention claimed is:

1. An aluminum alloy having a composition consisting of Si: 0.03 to 0.6 mass %, Fe: 0.1 to 0.7 mass %, Cu: 0.05 to 0.17 mass %, Mn: 1.06 to 1.20 mass %, Mg: 0.02 to 0.05 mass %, Zn: 0 to 0.02 mass %, Ti: 0.01 to 0.02 mass %, and the balance being Al and inevitable impurities.

2. A production method of an aluminum alloy extruded member, wherein an aluminum alloy billet having the composition as recited in claim 1 is extruded.

3. The production method of an aluminum alloy extruded member as recited in claim 2, wherein the extruded member is an aluminum alloy extruded tube for a photoconductor drum substrate.

4. A production method of a photoconductor drum substrate, wherein an aluminum alloy extruded tube for a photoconductor drum substrate obtained by the production method of an aluminum alloy extruded member as recited in claim 3 is drawn.

5. A production method of a photoconductor drum substrate, wherein an aluminum alloy extruded tube for a photoconductor drum substrate obtained by the production method of an aluminum alloy extruded member as recited in claim 3 is ironed.

6. An aluminum alloy extruded member having a composition consisting of Si: 0.03 to 0.6 mass %, Fe: 0.1 to 0.7 mass %, Cu: 0.05 to 0.17 mass %, Mn: 1.06 to 1.2 mass %, Mg: 0.02 to 0.05 mass %, Zn: 0 to 0.02 mass %, Ti: 0.01 to 0.02 mass %, and the balance being Al and inevitable impurities.

7. The aluminum alloy extruded member as recited in claim 6, wherein the extruded member is an aluminum alloy extruded tube for a photoconductor drum substrate.

8. A photoconductor drum substrate made of an aluminum alloy having a composition consisting of Si: 0.03 to 0.6 mass %, Fe: 0.1 to 0.7 mass %, Cu: 0.05 to 0.17 mass %, Mn: 1.06 to 1.2 mass %, Mg: 0.02 to 0.05 mass %, Zn: 0 to 0.02 mass %, Ti: 0.01 to 0.02 mass %, and the balance being Al and inevitable impurities.

* * * * *